US007786964B2

(12) United States Patent
Sakashita

(10) Patent No.: US 7,786,964 B2
(45) Date of Patent: Aug. 31, 2010

(54) DISPLAY APPARATUS AND DISPLAY CONTROL METHOD THEREFOR

(75) Inventor: Yukihiko Sakashita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1147 days.

(21) Appl. No.: 11/371,913

(22) Filed: Mar. 10, 2006

(65) Prior Publication Data

US 2006/0221069 A1 Oct. 5, 2006

(30) Foreign Application Priority Data

Apr. 4, 2005 (JP) ..... 2005-107747

(51) Int. Cl.
*G09G 3/36* (2006.01)

(52) U.S. Cl. ..... 345/89; 345/690; 345/204

(58) Field of Classification Search ..... 345/204, 345/213, 38, 50, 55, 77, 87–104, 690
See application file for complete search history.

(56) References Cited

U.S. PATENT DOCUMENTS

| | | | | |
|---|---|---|---|---|
| 4,571,585 | A * | 2/1986 | Stein et al. | 345/96 |
| 6,501,451 | B1 | 12/2002 | Sakashita | 345/87 |
| 6,592,227 | B2 | 7/2003 | Ouchi et al. | 353/97 |
| 6,719,427 | B2 | 4/2004 | Sakashita et al. | 353/31 |
| 6,853,436 | B2 * | 2/2005 | Kim | 349/191 |
| 6,891,524 | B2 | 5/2005 | Sakashita | 345/89 |
| 7,145,535 | B2 * | 12/2006 | Takako et al. | 345/87 |
| 2003/0058229 | A1 * | 3/2003 | Kawabe et al. | 345/204 |
| 2003/0058264 | A1 * | 3/2003 | Takako et al. | 345/698 |
| 2004/0017343 | A1 * | 1/2004 | Adachi et al. | 345/87 |
| 2004/0041745 | A1 * | 3/2004 | Chen | 345/3.2 |
| 2005/0140626 | A1 | 6/2005 | Doyen et al. | 345/89 |
| 2006/0158411 | A1 | 7/2006 | Sakashita | 345/89 |
| 2006/0221069 | A1 | 10/2006 | Sakashita | 345/204 |

FOREIGN PATENT DOCUMENTS

| | | |
|---|---|---|
| JP | 6-189232 | 7/1994 |
| JP | 11-126050 | 5/1999 |
| JP | 2000-105579 | 4/2000 |
| JP | 2001-034238 | 2/2001 |
| JP | 2001-092432 | 4/2001 |
| JP | 2004-233679 | 8/2004 |
| JP | 2005-043875 | 2/2005 |
| JP | 2005-309326 | 11/2005 |

* cited by examiner

*Primary Examiner*—Amare Mengistu
*Assistant Examiner*—Dmitriy Bolotin
(74) *Attorney, Agent, or Firm*—Fitzpatrick, Cella, Harper & Scinto

(57) ABSTRACT

A display apparatus includes a drive correction unit that compares image data items on a frame basis and changes a driving voltage on the frame basis for image data to be displayed, in accordance with the result of the comparison, and a magnification unit that raises at N times a frame rate of the image data to be displayed by the driving voltage changed by the drive correction unit, wherein N is an even number. In addition, a driving signal generation unit changes the polarity of the driving voltage for the image data to be displayed at the raised frame rate raised by the magnification unit and generates a display driving signal.

12 Claims, 19 Drawing Sheets

DISPLAY APPARATUS AND DISPLAY CONTROL METHOD THEREFOR

FIELD OF THE INVENTION

The present invention relates to a display apparatus such as a liquid crystal and the like and to a display control method therefor.

BACKGROUND OF THE INVENTION

In recent years, a liquid-crystal display apparatus has been utilized as a display apparatus of a TV receiver or a personal computer. Because a liquid-crystal display apparatus such as this can be formed in a thin shape, whereby it is space-saving, and is power-saving, it has widely been utilized. However, a liquid-crystal display apparatus such as this has a problem in that response time between input of image data and actual display is long. In this regard, as a drive method to improve the response speed of a liquid-crystal display apparatus, it has been proposed that image data to be displayed is compared with the immediate previous image data and over-voltage driving with raised voltage is implemented in accordance with the result of the comparison (refer to Japanese Patent Laid-Open No. 11-126050).

FIG. 17 is a graph for explaining an example of the over-voltage driving signal; the ordinate denotes the voltage applied to a liquid crystal, and the abscissa denotes the elapse of time. Reference numeral 1700 denotes the positive voltage of the driving signal in the case of normal driving, and reference numeral 1701 denotes the positive voltage in the case of the over-voltage driving, and reference numeral 1702 denotes an optical response to the over-voltage driving, and reference numeral 1703 denotes an expected optical response in the case where the over-voltage driving is recurrently implemented. In addition, reference numeral 1704 denotes an optical response of the liquid crystal to the normal driving.

As shown in FIG. 17, due to the over-voltage driving being implemented at only one side of the AC driving (at the positive side in FIG. 17), a DC component remains; therefore, depending on the structure or the configuration of the liquid-crystal display apparatus, reliability of the liquid-crystal display apparatus may be deteriorated. Therefore, for a liquid-crystal display apparatus in which a pixel electrode and an opposite electrode are arranged on the same substrate and a voltage is generated in parallel with the substrate, a method has been proposed (refer to Japanese Patent Laid-Open No. 2001-34238) in which by, as a countermeasure, forming at least one of the pixel electrode and the opposite electrode with an ITO film, the deterioration of the reliability, due to the DC component, is prevented.

In the foregoing liquid-crystal display apparatus in which a pixel electrode and an opposite electrode are arranged on the same substrate and a voltage is generated in parallel with the substrate, by employing a structure in which at least one of the pixel electrode and the opposite electrode is formed with an ITO film, the deterioration of the reliability, due to a DC component caused by over-voltage driving, can be prevented. However, for that purpose, it is necessary to change the panel structure of a liquid-crystal display apparatus, whereby it has been a problem that the structure cannot universally be applied to various kinds of liquid-crystal display apparatuses.

SUMMARY OF THE INVENTION

The present invention is to solve the foregoing disadvantages of conventional techniques.

In addition, the feature of the present invention is to provide a display apparatus in which imbalance, in DC components, due to over-voltage driving is eliminated, whereby the response speed and the reliability are improved, and a display control method therefor.

According to the present invention, there is provided with a display apparatus comprising:

drive correction means for comparing image data items on a frame basis and changing a driving voltage for image data to be displayed, in accordance with the result of the comparison;

magnification means for raising at N times a frame rate of the image data to be displayed by the driving voltage changed by said drive correction means; and driving signal generation means for changing the polarity of the driving voltage for the image data to be displayed at the frame rate raised by said magnification means and generating a display driving signal.

Further, according to the present invention, there is provided with a display control method for a display apparatus, comprising:

a drive correction step of comparing image data items on a frame basis and changing a driving voltage for image data to be displayed in accordance with the result of the comparison;

a magnification step of raising at N times a frame rate of the image data to be displayed, that is displayed by the driving voltage changed in said drive correction step; and a driving signal generation step of changing the polarity of the driving voltage for the image data to be displayed at the frame rate raised in said drive correction step and generating a display driving signal.

The feature can be achieved by the combination of features described in the independent claims, and the dependent claims are to specify further advantageous illustrative embodiments of the present invention.

In addition, the summary of the present invention does not enumerate all necessary features; therefore, a subcombination of these features may be an invention.

Other features, objects and advantages of the present invention will be apparent from the following description when taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Hereinafter, preferred embodiments of the present invention will be explained in detail, with reference to the accompanying drawings. The embodiments described below do not limit thereto the invention related to the claims, and all the combinations of features described in the embodiments are not necessarily requisite to solution means of the present invention.

First Embodiment

Figure 1:
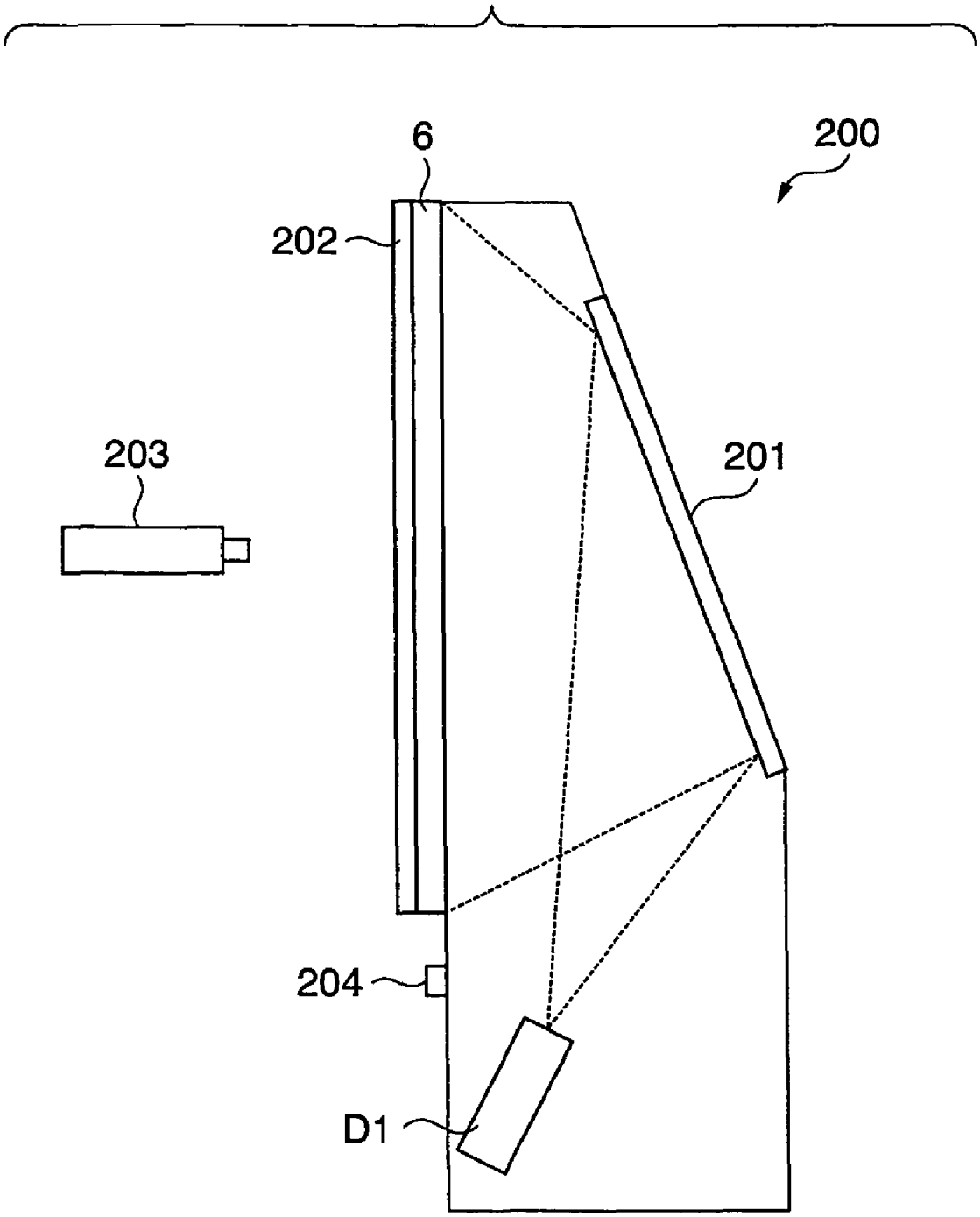
FIG. 1 depicts a side view of a rear-projection-type display apparatus according to the present embodiment.

FIG. 1 depicts a side view of a rear-projection-type display apparatus 200 according to the present embodiment.

In FIG. 1, an image projected from a projection-type display engine D1 is reflected by a reflecting mirror 201 and projected onto a screen 6 from the rear side thereof. A digitizer 202 is mounted on the front face of the screen 6. By designating by using a pen 203 for the digitizer a position on the front face of the screen 6 of the digitizer 202, the coordinates of the designated position can be inputted to the display apparatus 200. As the digitizer, various kinds of devices, such as an optical device, a pressure-sensitive device, or an ultrasonic device, can be utilized. A brightness adjustment switch 204 is a device for adjusting brightness of an image displayed on the screen 6.

Figure 2:
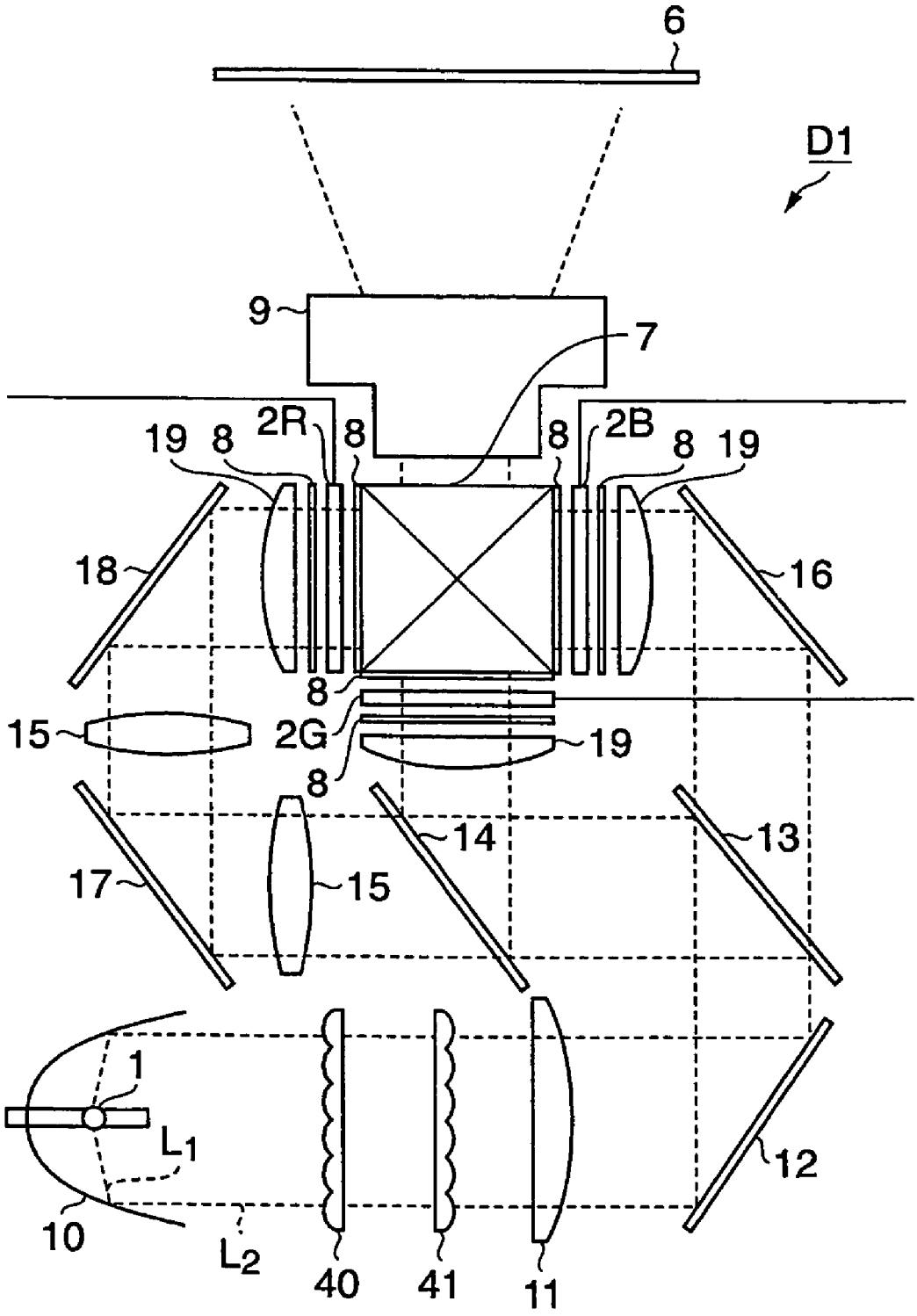
FIG. 2 depicts a view for explaining the structure of the projection-type display engine D1 according to the present embodiment.

FIG. 2 depicts a view for explaining the structure of the projection-type display engine D1 according to the present embodiment.

In the projection-type display engine D1, three respective liquid-crystal panels 2R, 2G, and 2B corresponding to colors R, G, and B are utilized as light modulation devices, and are arranged at respective positions opposing a cross prism. In addition, in the present embodiment, as the liquid-crystal panels 2R, 2G, and 2B, TN-type liquid-crystal panels driven by means of TFTs are utilized. Additionally, a pair of polarization plates 8 is arranged at both sides of each of the liquid-crystal panels 2R, 2G, and 2B in such a way as to flank each liquid-crystal panel; at the light-emitting side of the cross prism 7, a projection lens 9 and the screen 6 (a member onto which light is projected) are arranged.

Meanwhile, by arranging a paraboloidal reflector 10 in such a way as to surround a lamp (light source) 1, exiting light L1 from the lamp 1 is converted into parallelized light beams L2. In addition, instead of being paraboloidal, the reflector 10 may be an ellipsoidal device so that light is converted into condensed light beams. As the lamp 1, a metal halide lamp, a xenon lamp, or the like can be utilized. Fly's eye type integrators 40 and 41 are arranged in the light path of light emitted from the lamp 1, in such a way as to be in a conjugate relation ship with the liquid-crystal panels 2R, 2G, and 2B, whereby nonuniformity is improved. Additionally, at the light-emitting side of the fly's eye type integrator 40 and 41, a relay lens 11 and a mirror 12 are arranged in that order. Additionally, two dichroic mirrors 13 and 14 are arranged so that exiting light from the lamp 1 is split into three light beams, and a relay lens 15 and mirrors 16, 17, and 18 are arranged so that the respective split light beams are led to the liquid-crystal panels 2R, 2G, and 2B. In addition, reference numeral 19 denotes field lenses.

Figure 3:
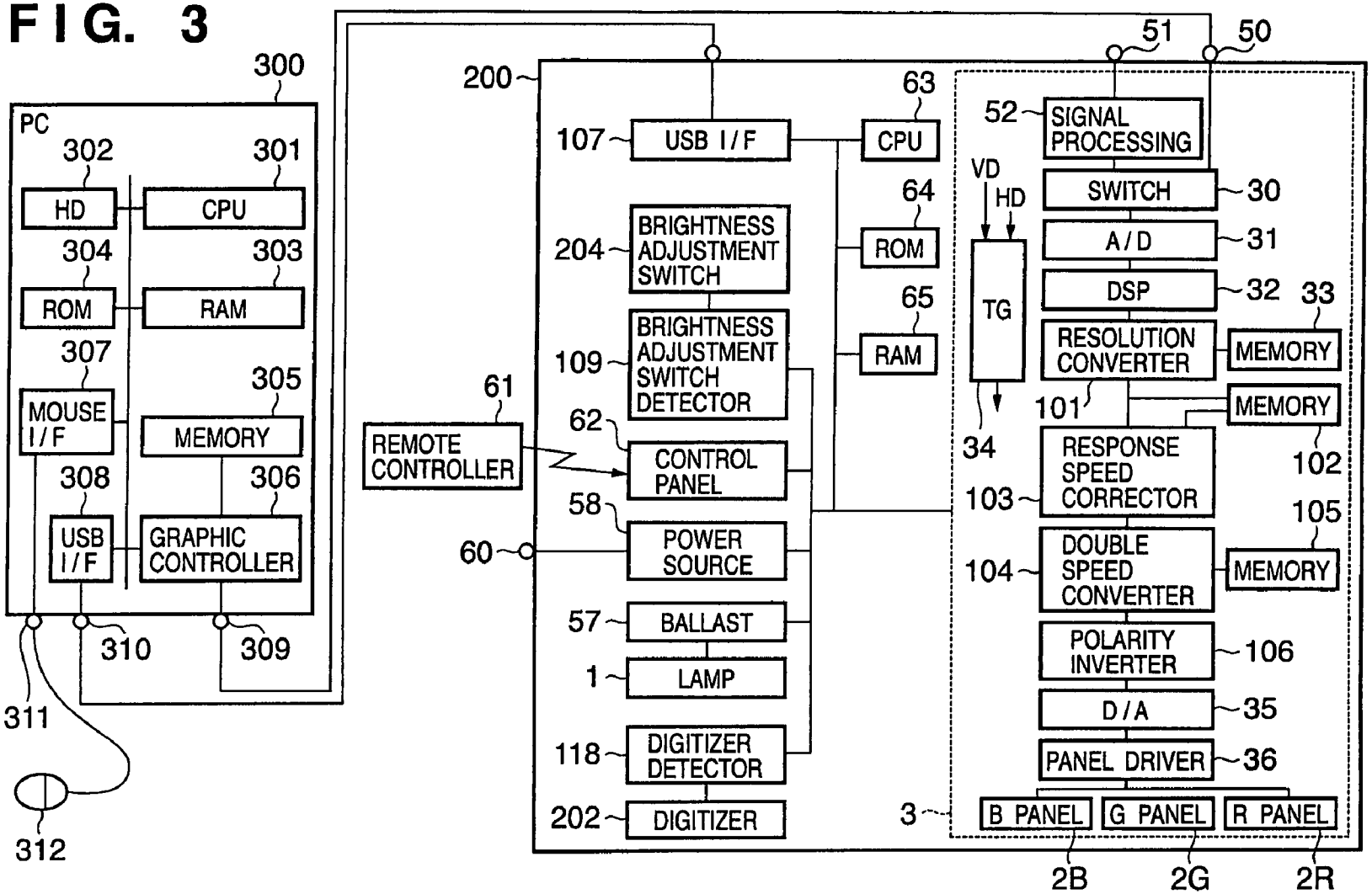
FIG. 3 is a block diagram illustrating the configuration of a display engine of a display apparatus according to a first embodiment of the present invention.

Meanwhile, a video signal processor 3 as illustrated in FIG. 3 and the like are connected to the liquid-crystal panels 2R, 2G, and 2B.

Next, electric-signal processing in a projection-type display engine D1 according to the present embodiment will be explained.

FIG. 3 is a block diagram illustrating the configuration of a display engine of a display apparatus according to the first embodiment of the present invention.

In the video signal processor 3, a switch 30 switches a video signal inputted through a terminal 50 from a PC 300 and an NTSC signal inputted from a terminal 51. A signal processing circuit 52 applies to an NTSC signal inputted through the terminal 51 signal processing such as decoding of the NTSC signal, noise-reduction processing, bandwidth-limiting filtering, and signal-level adjustment. An A/D converter 31 converts an inputted analogue video signal into a digital signal. A DSP (Digital Signal Processor) 32 receives and applies signal processing to the A/D-converted digital image data and outputs the resultant data. A resolution converter 101 implements conversion of the resolution of the inputted image data. A memory 33 stores image data of a current frame, image data to be displayed in the following frame, and the like. A timing generator 34 outputs a timing signal that specifies operation timing for respective sections. A memory 102 stores image data items that have been displayed in the previous frames, in order to correct response speed. A response speed corrector 103 compares image data (to be displayed) outputted from the resolution converter 101 with image data (displayed already) that has passed through the memory 102, and then corrects response speed. A double speed converter 104 creates image data for double-speed conversion, by means of a memory 105. A polarity inverter 106 reverses the polarity of the image signal based on the image data. A D/A converter 35 converts the digital image data into an analogue image signal. A panel driver 36 generates video signals based on the analogue image signal and supplies the video signals to the liquid-crystal panels 2R, 2G, 2B. A driving power supply of the liquid-crystal panels 2R, 2G, 2B is also supplied by the panel driver 36. In addition, in the DSP 32, image processing such as contrast adjustment, brightness adjustment, color conversion, and the like are implemented.

In this situation, in the block diagram, only analogue input signals are illustrated, however, it goes without saying that, instead of those, provision of input terminals for digital signals such as an LVDS or a TMDS and a D4 terminal for a digital TV is also effective.

A ballast 57 is an electric power source for a lamp 1, connected to the lamp 1. Reference numerals 58 and 60 denote a system electric power source and an AC inlet, respectively. A remote controller 61 instructs various operation items for the display apparatus. A control panel 62 receives a signal from the remote controller 62.

Moreover, reference numeral 204 denotes the brightness adjustment switch, and a brightness adjustment switch detector 109 detects the state of the brightness adjustment switch 204. A digitizer detector 118 detects the coordinates indicated by the digitizer 202. Reference numeral 107 denotes a USB/IF. Still moreover, and reference numerals 63, 64, and 65 denote a CPU, a ROM, and a RAM, respectively. The CPU 63 is connected to the video signal processor 3, the control panel 62 the ballast 57, the brightness adjustment switch detector 109, the digitizer detector 118, the USBI/F 107, and the like, and implements drive control of liquid-crystal panels 2R, 2G, and 2B and the lamp 1, and enlargement, diminution, and shifting of an display image.

In the present embodiment, it has been explained that the brightness adjustment switch detector 109, the digitizer detector 118, the USB-I/F 107, and the like are connected to the CPU 63, however, the display engine may be configured in such a way that the CPU 63 and a program therefor realize the functions of the foregoing constituent elements.

Next, the configuration of a PC (personal computer) connected to the display apparatus will be explained.

The PC 300 has a CPU 301, an HD (hard disc) 302, a RAM 303, a ROM 304, a video memory 305, a graphic controller 306, a mouse I/F 307, a USB I/F 308, and the like, and is equipped with a video output terminal 309, a USB input terminal 310, and a mouse input terminal 311. A mouse 312 functions as a pointing device and is connected to the mouse input terminal 311.

Next, the operation of the display device according to the first embodiment will be explained with reference to FIGS. 3 and 4 to 7.

FIGS. 4-7 are charts for explaining contents of processing in a display device according to the first embodiment, and depict respective signal waveforms at the processing sections.

Either one of a video signal inputted through the PC input terminal 50 and a video signal inputted through the NTSC input terminal 51 is selected by the switch 30. The A/D converter 31 converts the selected signal from an analogue signal into a digital signal. Subsequently, the DSP 32 applies to the digital image processing such as contrast adjustment, brightness adjustment, color conversion, and the like. The image data outputted from the DSP 32 is further converted by the resolution converter 101 into image data having a desired resolution and a desired frame rate. In the present embodiment, a case will be explained where the outputted image data is converted into image data having a frame rate of 60 Hz. On that occasion, by storing, in the memory 33, inputted image data for at least one frame and changing the speed of reading the image data from the memory 33, the inputted image data can be converted into an image signal having a frame rate different from that of the inputted image signal.

FIGS. 4 to 7 are charts representing respective signals that, in signal processing sections, drive a specific pixel in a liquid-crystal panel in the display apparatus according to the first embodiment.

Figure 4:
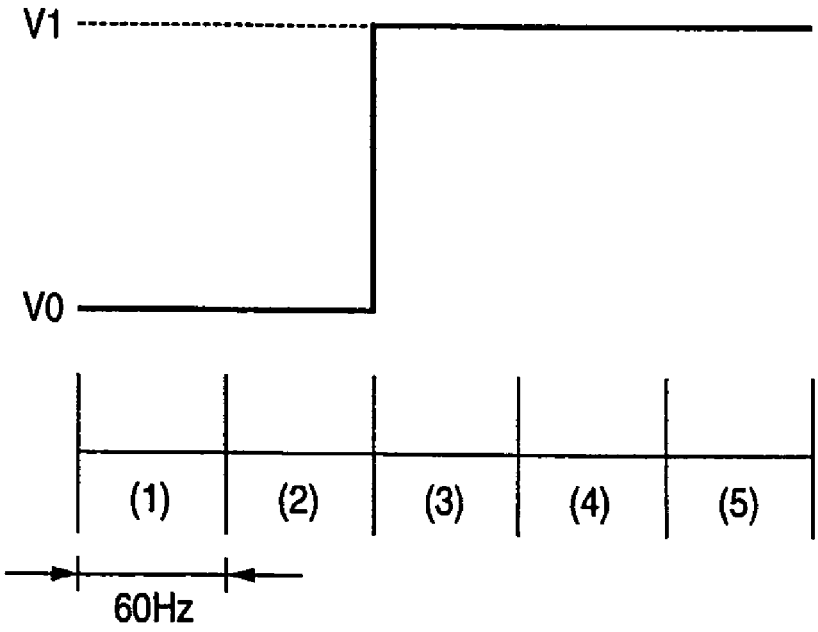
FIG. 4 is a chart representing a signal that is outputted from the resolution converter according to the first embodiment and drives a specific pixel.

FIG. 4 is a chart representing a signal that is outputted from the resolution converter 101 and drives the specific pixel to display at a frame rate of 60 Hz.

Figure 5:
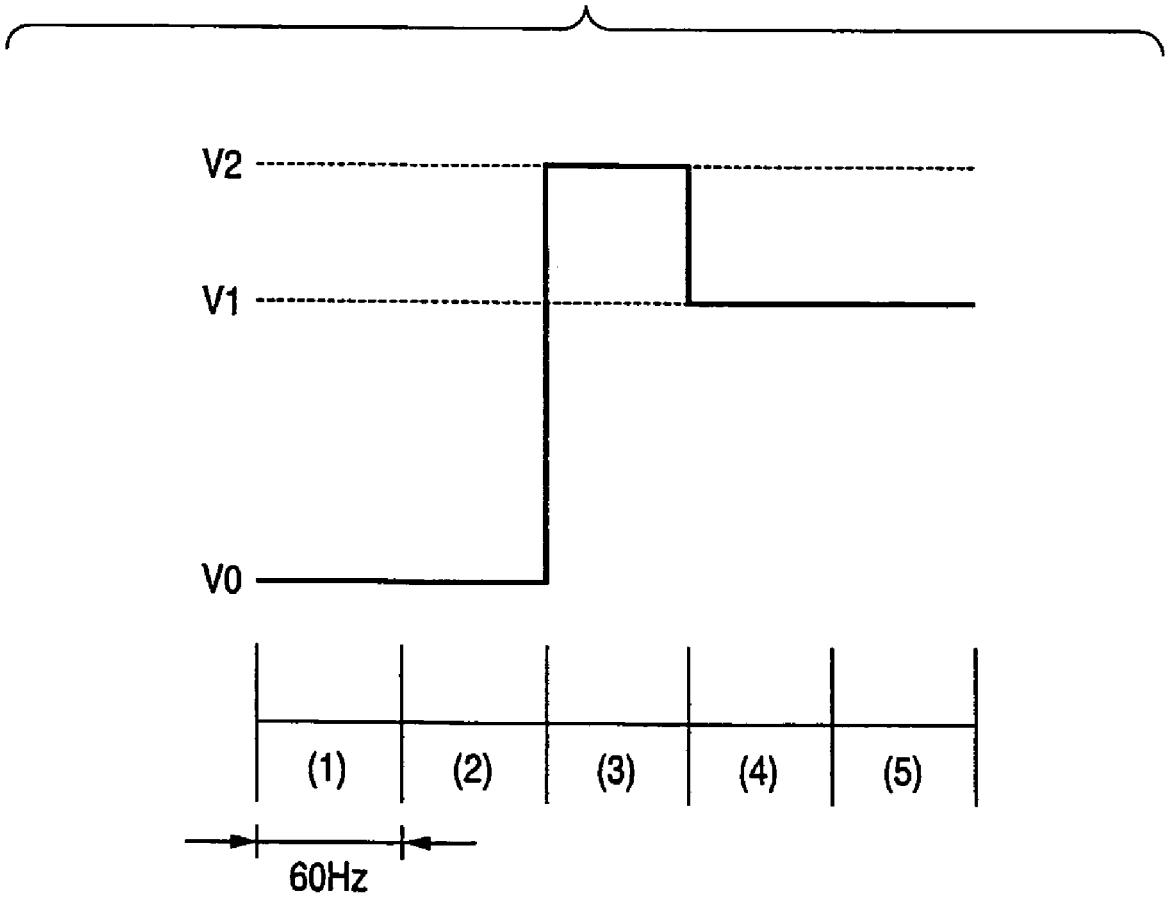
FIG. 5 is a chart representing an example, in the first embodiment, in which display driving is implemented, with an over-driving amount added, in Frame (3) where the pixel data changes from the black-color to the halftone-gradation data.

In Frames (1) and (2), black-color pixel data (voltage V0) is applied to the pixel, and the pixel data is changed in Frame (3) to halftone-gradation pixel data (voltage V1). In this situation, in the response speed corrector 103, so-called over-voltage driving is implemented so as to improve the response speed of the liquid-crystal display apparatus. The voltage in the case of the over-voltage driving is defined V2 (V2>V1). In the response speed corrector 103, one-frame-prior pixel data that has been displayed and stored in the memory 102 is compared with pixel data of a current frame. In this situation, if any pixel-data change exists, the over-voltage driving is implemented in response to the result. In the example in FIG. 4, because the pixel data at the timing of displaying Frame (3) is different from the pixel data for the prior Frame (2), the over-voltage driving is implemented. FIG. 5 represents the foregoing situation.

FIG. 5 is a chart representing an example in which, by adding an over-driving amount to the pixel data, in Frame (3) where the pixel data changes from the black color to the halftone gradation, the driving of the pixel is implemented with the voltage V2.

With regard to processing in and after Frame (4) in FIG. 5, because the pixel data in Frame (3) in FIG. 4 and the pixel data in Frames (4) and (5) in FIG. 4 are equal to each other, the over-voltage driving is not implemented.

Correction methods, for the response speed, implemented in the response speed corrector 103 include, for example, a method in which, by means of an LUT (look-up table), the correction amount is changed, in accordance with the difference between the level of one-frame-prior pixel data and the level of pixel data to be displayed in the current frame, and a method in which the correction amount is decided, in accordance with the result of the subtraction between one-frame-prior pixel data and pixel data to be displayed in the current frame. With the former method in which the LUT is utilized, it is made possible to implement optimal over-voltage driving in accordance with change in the pixel-data level, for example, enhancement of the correction amount for an image area, having the halftone gradation, in which the response speed is low.

In the double speed converter 104, the image data outputted from the response speed corrector 103 is stored in the memory 105 and then read at a double frame rate. Accordingly, the frame rate is converted into a double rate. In consequence, as represented in FIG. 6, the frame rate of the outputted image data is converted into 120 Hz.

Figure 6:
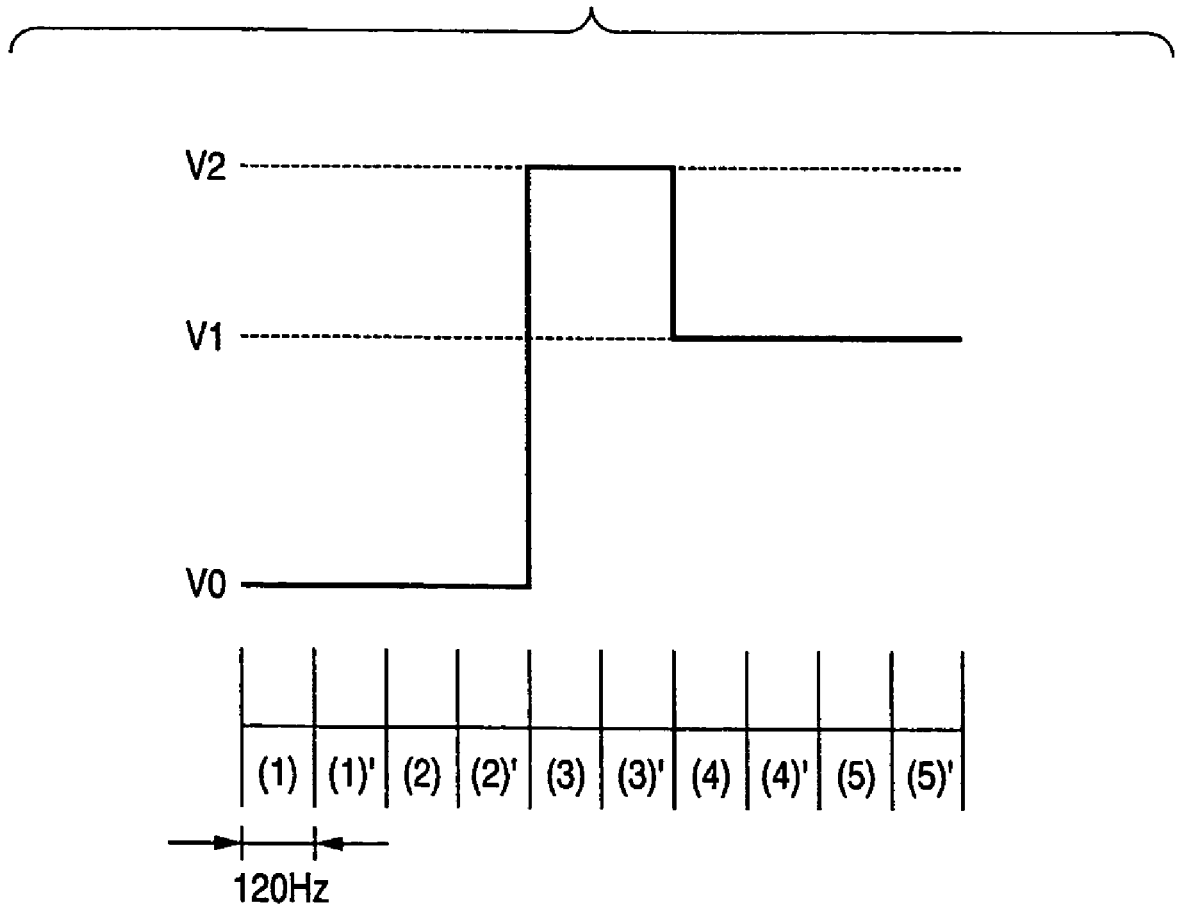
FIG. 6 depicts a view representing a state of display driving in the case where, in the example of display driving in FIG. 5, the frame rate is doubled.

FIG. 6 depicts a view representing a state of display driving in the case where, in the example of display driving in FIG. 5, the frame rate is doubled.

In FIG. 6, each one frame represented in FIG. 5 is designated by two frames, for example, Frames (1) and (1)' for Frame (1) and Frames (2) and (2)' for Frame (2) (and so forth).

Next, in the polarity inverter 106, the polarity of the signal is reversed on one frame basis, after the frame where the double-speed conversion has been implemented, and then the resultant signal is outputted.

Figure 7:
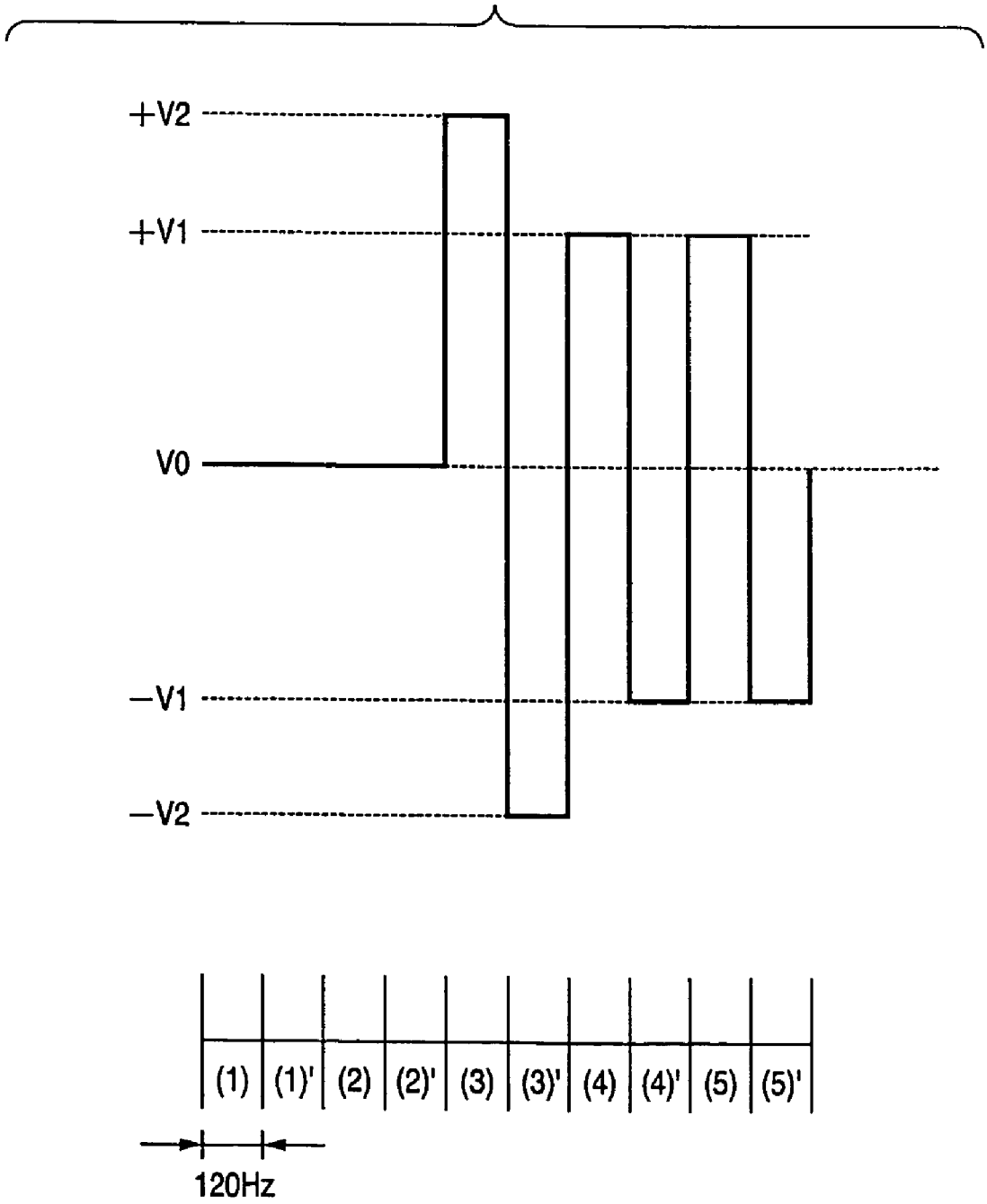
FIG. 7 is a chart representing a state in which the polarity of the signal, represented in FIG. 6, to which the double-speed conversion has been applied is reversed on a frame basis, in a polarity inverter according to the first embodiment.

FIG. 7 is a chart representing a state in which the polarity of the signal, represented in FIG. 6, to which the double-speed conversion has been applied is reversed on a frame basis by the polarity inverter 106 according to the first embodiment. In addition, Frames in FIG. 7 are the same as those in FIG. 6; the absolute values of the driving voltages V1 and V2 in FIG. 7 are the same as those in FIG. 6.

Figure 18:
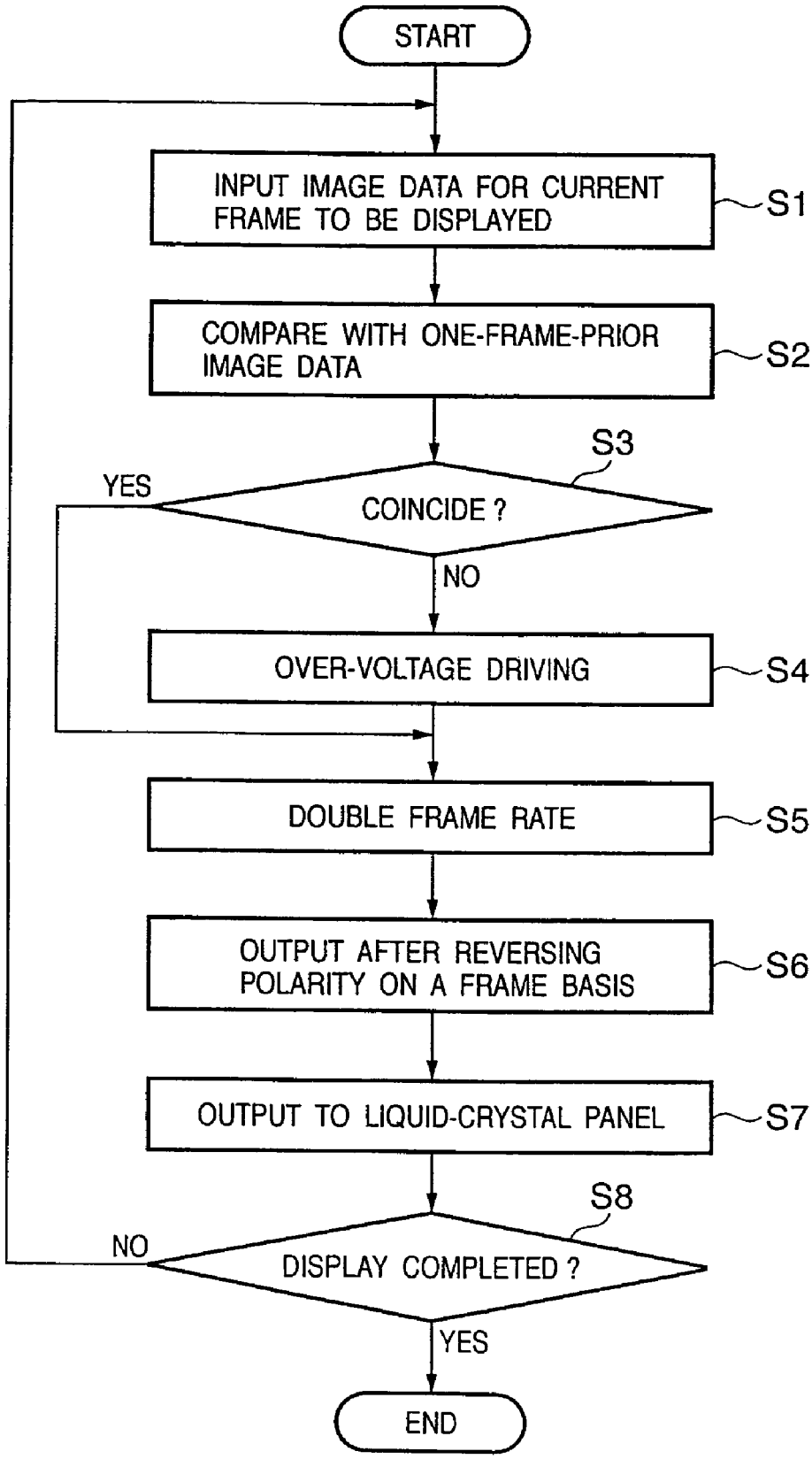
FIG. 18 is a flowchart for explaining processing according to the first embodiment of the present invention.

FIG. 18 is a flowchart for explaining response-speed correction according to the first embodiment of the present invention, and the processing of the response-speed correction is implemented by the response speed corrector 103, the double speed converter 104, and the polarity inverter 106, however, that processing may be implemented under the control of the CPU 63, based on a program stored in the ROM 64.

In the step S1 in the first place, respective pixel data items for an image to be displayed in a current frame are inputted, and in the step S2, the respective pixel data items are compared with corresponding pixel data items, for a one-frame-prior image, that have been stored in the memory 102. In the case where the respective pixel data items for the frames coincide to each other, the process advances to the step S5. On the other hand, in the case where the respective pixel data items for the frames do not coincide to each other, the process advances to the step S4, and in displaying a pixel where respective pixel data items do not coincide to each other, the driving voltage is raised to implement the over-voltage driving. Subsequently, in the step S5, the double speed converter 104 doubles the frame rate of the image data. Next, in the step S6, the polarity inverter 106 reverses on a frame basis the polarity of the driving signal and outputs to the D/A converter 35. In the step S7, the liquid-crystal panel is driven to display. In the step S8, it is determined whether or not the image-display processing has been completed. If the image-display processing has not been completed, the process returns to the step S1, and the above mentioned processing is applied to the image data for the following frame.

Accordingly, the over-voltage driving is implemented equally in normal-polarity driving and in reversed-polarity driving.

As explained heretofore, according to the first embodiment, because a balance in the voltage for the over-voltage driving is ensured between normal-polarity driving and reversed-polarity driving, the reliability of display is raised.

Second Embodiment

Next, the second embodiment of the present invention will be explained. In the second embodiment, a method will be explained in which, compared with the first embodiment described above, the capacity of the frame memory 102 is reduced, whereby a low-cost display apparatus is realized.

In the first embodiment described above, in a display apparatus in which reversed-polarity driving is implemented, the resolution converter 101 that converts an input signal into a signal having a predetermined frame rate, the response speed corrector 103 that implements comparison of the output from the resolution converter 101 and correction of the response speed, and the double speed converter 104 that doubles frame rate for reverse-polarity driving are utilized.

In contrast, in the second embodiment, since the resolution converter 101 reads image data at a double speed (preliminarily at a frame rate required for reversed-polarity driving), the frame memory 105 for the double-speed driving in the first embodiment is no longer required. Further, a problem (the imbalance between the normal-polarity driving and the reversed-polarity driving at AC driving causes deterioration of a liquid crystal), in response-speed correction, that is caused by that the resolution converter 161 reads the image data at a double speed is prevented.

Hereinafter, the second embodiment will be explained in detail.

Figure 8:
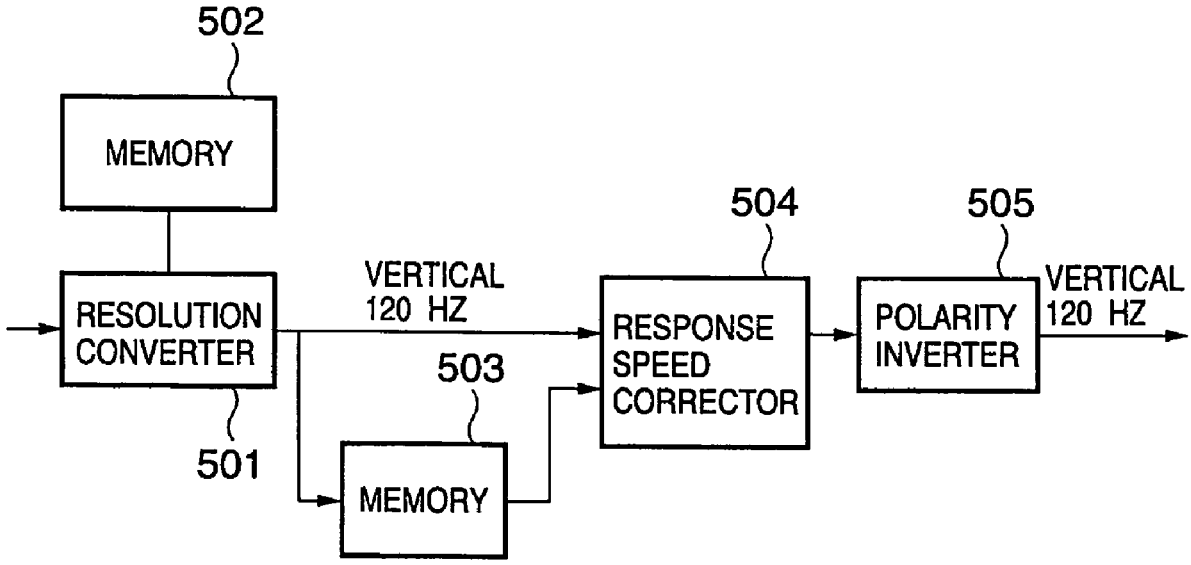
FIG. 8 is a block diagram for explaining signal processing methods including a response speed corrector according to a second embodiment of the present invention.

FIG. 8 is a block diagram for explaining signal processing methods at signal processing sections including a response speed corrector according to the second embodiment of the present invention. In addition, the configuration of the display engine of a display apparatus according to the second embodiment is the same as the block diagram illustrated in FIG. 3, except for the configuration illustrated in FIG. 8; therefore, the explanation for the same configuration will be omitted.

In FIG. 8, a memory 502 stores image data displayed in the current frame and image data to be displayed in the following frame. A memory 503 stores image data in the previous frames, in order to correct the response speed. A response speed corrector 504 is the same as the response speed corrector 103 described above. In addition, a polarity inverter 505 is also the same as the polarity inverter 106, therefore, explanations for them will be omitted. Image data outputted from the polarity inverter 505 is displayed on a liquid-crystal panel, through a D/A converter 35 and the like, as shown in FIG. 3.

Next, the operation of the second embodiment will be explained with reference to FIGS. 8 and 9 to 12.

FIGS. 9 to 12 are charts for explaining contents of processing according to the second embodiment, and represent respective signal waveforms at processing sections.

What the second embodiment differs from the first embodiment is that, after the resolution converter 501 converts the frame rate to 120 Hz, the response speed corrector 504 corrects the response speed. What the second embodiment differs from the first embodiment is also that image data to be referred to in the response speed corrector 504 is altered.

Image data inputted to the resolution converter 501 is converted by the resolution converter 501 into image data having a desired resolution and a desired frame rate. In the second embodiment, the image data is converted to image data having a frame rate of 120 Hz. On that occasion, by storing, in the memory 502, inputted image data for at least one frame and changing the speed of reading the image data, the inputted image data is converted into image data having a frame rate different from that of the inputted image signal.

Figure 9:
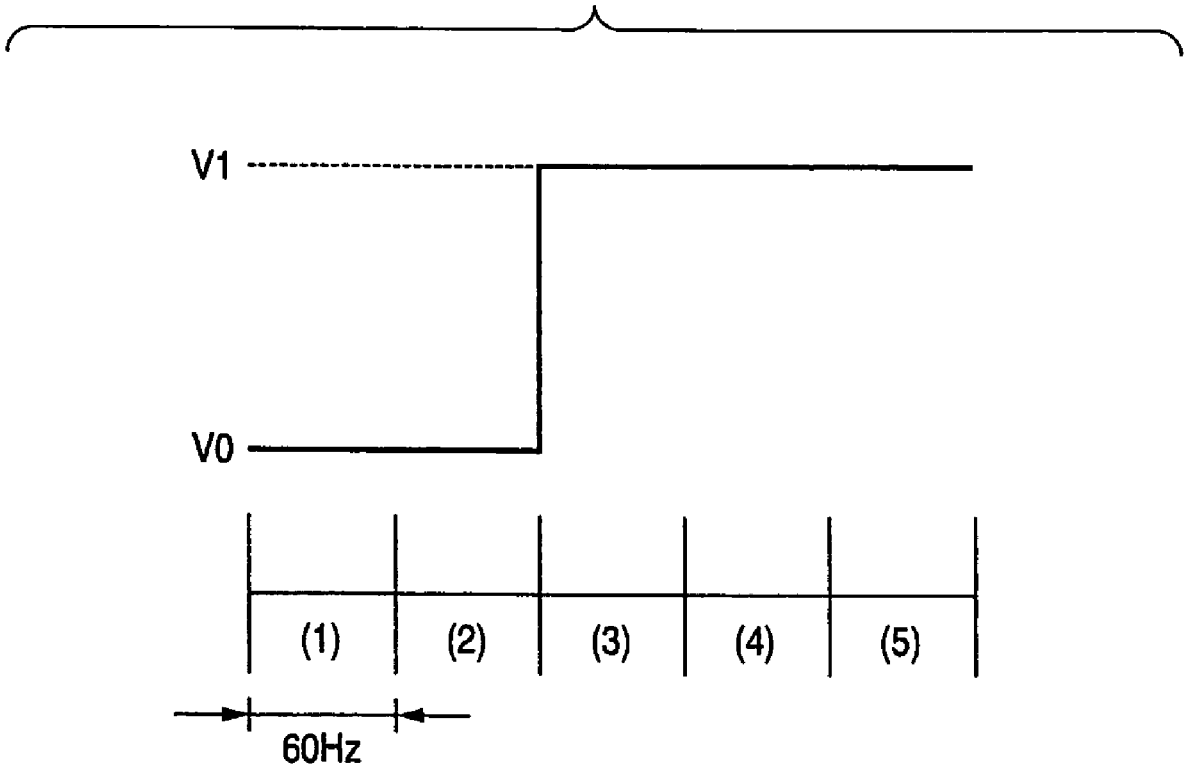
FIG. 9 is a chart representing a signal that is inputted to a resolution converter according to the second embodiment and drives a specific pixel of a liquid-crystal panel.

FIG. 9 is a chart representing a signal that is inputted to the resolution converter 501 and drives a specific pixel on the liquid-crystal panel.

In this situation, the frame rate for displaying an image is 60 Hz. In Frames (1) and (2), a black-color signal (voltage V0) is applied to the pixel, and the black-color signal is changed in Frame (3) to halftone-gradation pixel data (voltage V1).

Figure 10:
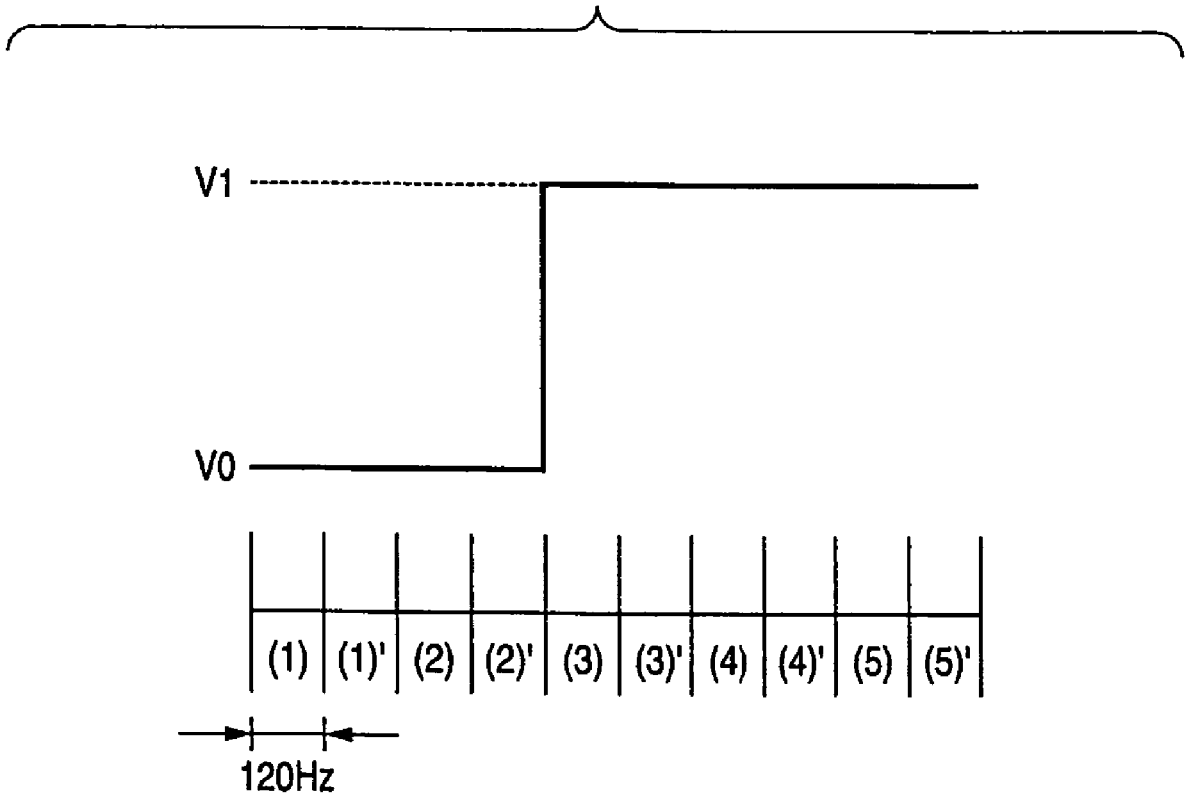
FIG. 10 is a chart representing image data outputted from the resolution converter according to the second embodiment.

FIG. 10 is a chart representing image data outputted from the resolution converter 501. In FIG. 10, as is the case with FIG. 6, the frame rate is converted to 120 Hz. In other words, each one frame represented in FIG. 9 is designated by two: frames, for example, Frames (1) and (1)' for Frame (1) and Frames (2) and (2)' for Frame (2) (and so forth).

In the second embodiment, the resolution converter 501 converts the frame rate of an image, from 60 Hz to 120 Hz. In the resolution converter 501, by reading, twice in series, image data stored in the memory 502, the frame rate is doubled. Next, in order to improve the response speed of the liquid-crystal display apparatus, the response speed corrector 504 implements so-called over-voltage driving.

Figure 11:
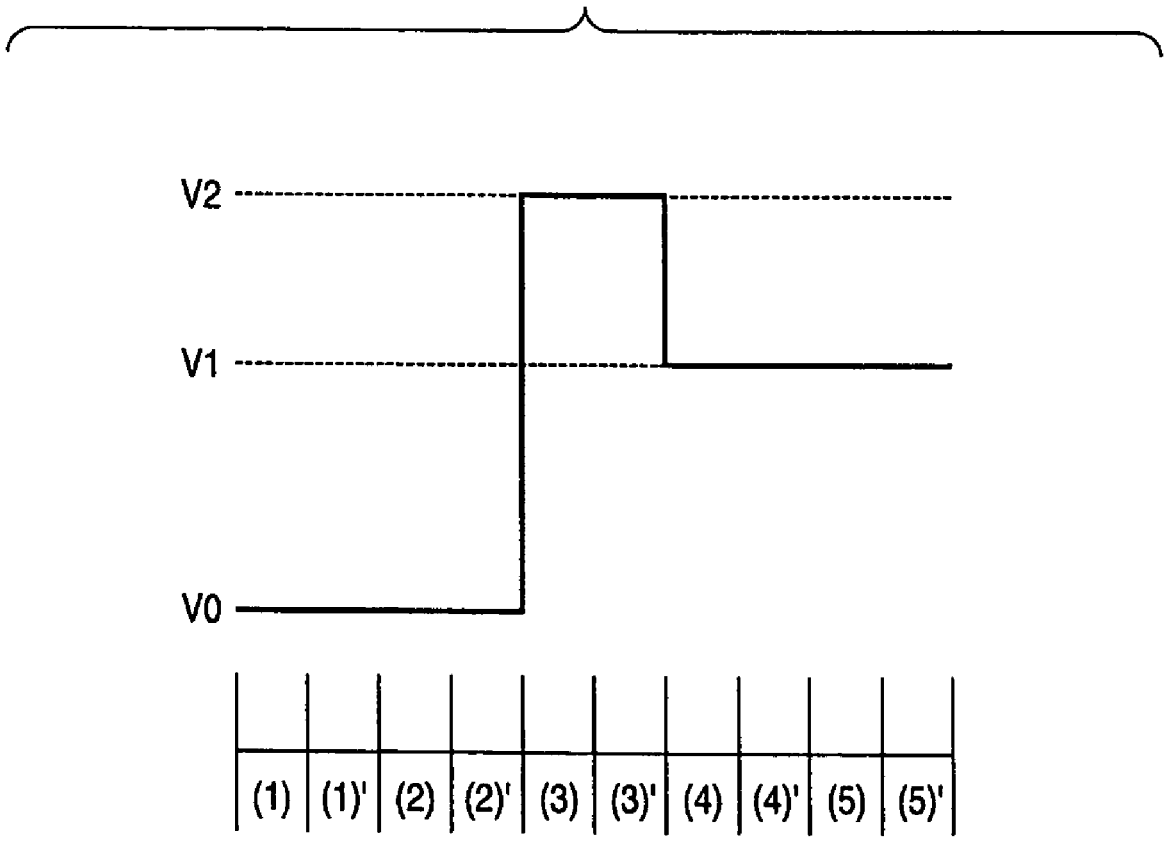
FIG. 11 is a chart representing image data outputted from the response speed corrector according to the second embodiment.

FIG. 11 is a chart representing a signal that is outputted from the response speed corrector 504 according to the second embodiment and drives a specific pixel to display at a frame rate of 60 Hz.

The response speed corrector 504 compares pixel data, for a two-frame-prior image, that has been stored in the memory 503 and pixel data for an image to be displayed in a current frame. If a difference in the data items exists, the over-voltage driving is implemented in accordance with the result of the comparison. In the example in FIG. 10, pixel data items in Frames (3) and (3)' are different from those in respective two-frame-prior Frames (2) and (2)', therefore, as represented in FIG. 11, the over-voltage driving is implemented with a voltage V2, in the Frames (3) and (3)'. Pixel data items in and after Frames (4) and (4)' subsequent to Frames (3) and (3)' in FIG. 10 are the same as those in respective two-frame-prior Frames (3) and (3)' to (5) and (5)', therefore, the over-voltage driving is not implemented.

As discussed above, in the example in FIG. 11, driving is implemented, with an extra voltage for overdriving added, in Frames (3) and (3)' in which change occurs in the pixel data, from the black-color level to the halftone-gradation level. In this situation, in each of Frames (3) and (3)', the same amount of over-voltage driving is implemented.

Methods for the response-speed correction include, for example, a method in which, by means of an LUT, the correction amount is changed, in accordance with the input level of one-frame-prior image data and the input level of image data to be displayed in a current frame, and a method in which the correction amount is decided, in accordance with the result of the subtraction between one-frame-prior image data and the image data to be displayed in the current frame. With the method in which the LUT is utilized, it is made possible to implement optimal over-voltage driving in accordance with change in the image-data level, for example, enhancement of the correction amount for an image area, having the halftone gradation, in which the response speed is low.

In the polarity inverter 505, the signal outputted from the response speed corrector 504 reverses its polarity every one frame whose rate has been converted to 120 Hz. Accordingly, as shown in FIG. 12, it is possible to implement the over-voltage driving equally in normal-polarity driving and in reversed-polarity driving.

Figure 12:
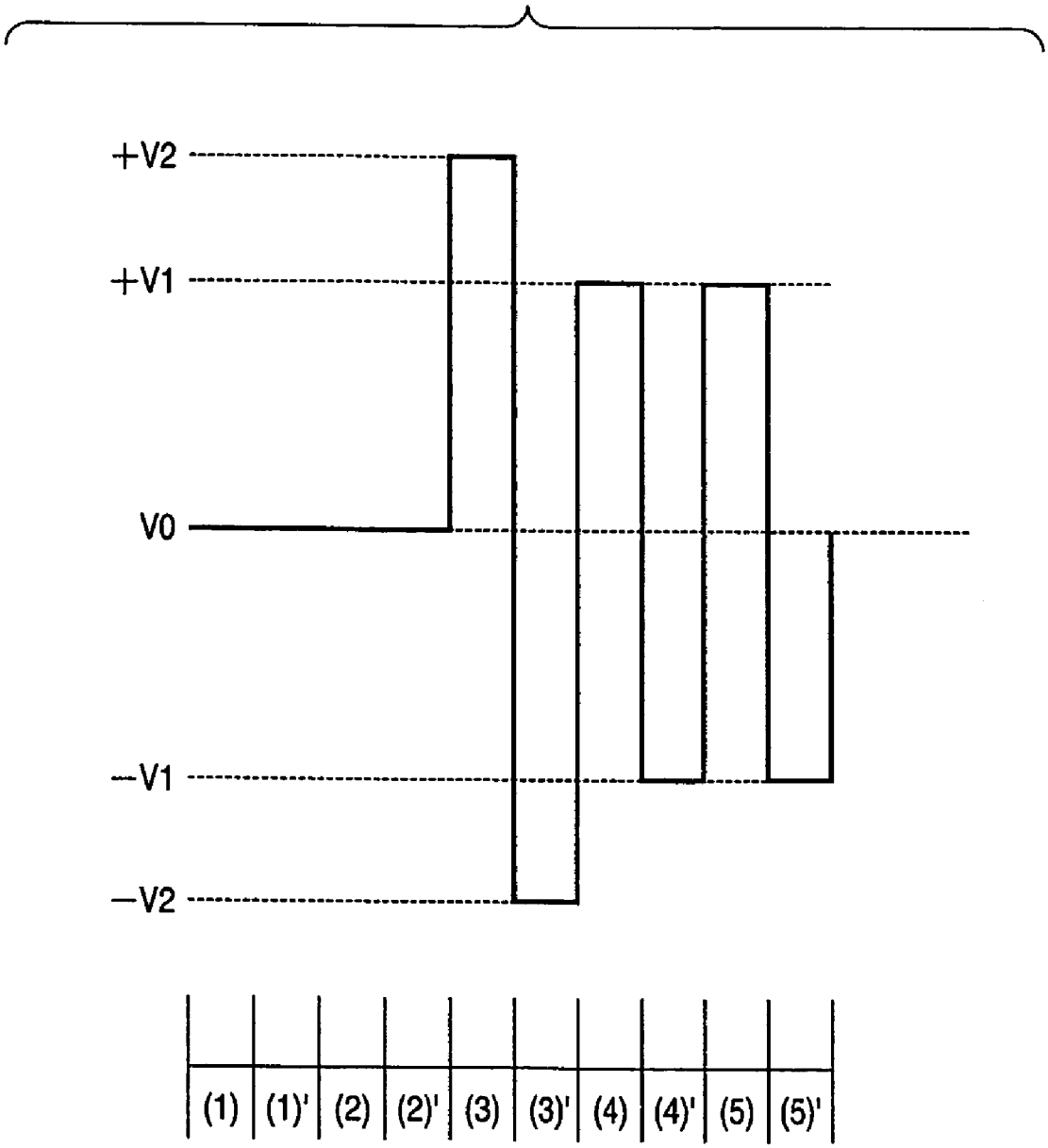
FIG. 12 is a chart representing a state in which the polarity of the signal, shown in FIG. 11, to which the double-speed conversion has been applied is reversed on a frame basis, in a polarity inverter according to the second embodiment.

FIG. 12 is a chart representing a state in which the polarity of the signal, as shown in FIG. 11, to which the double-speed conversion has been applied is reversed on a frame basis, in the polarity inverter 505 according to the second embodiment. In addition, Frames in FIG. 12 are the same as those in FIG. 11, and the absolute values of the driving voltages V1 and V2 are the same as those in FIG. 11.

Figure 19:
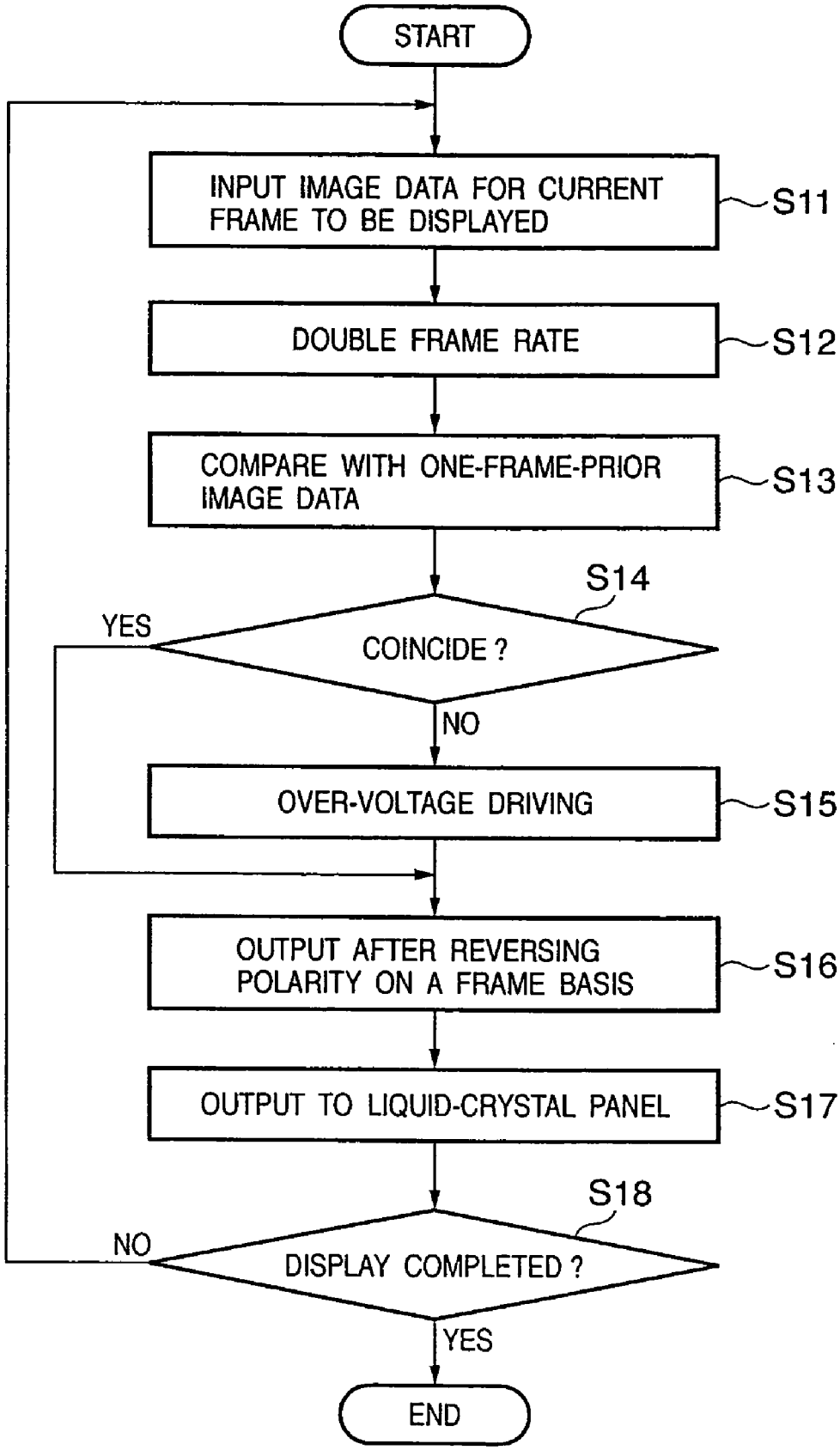
FIG. 19 is a flowchart for explaining processing according to the second embodiment of the present invention.

FIG. 19 is a flowchart for explaining response-speed correction according to the second embodiment of the present invention, and the processing of the response-speed correction is implemented by the response speed corrector 504 and the polarity inverter 505. The processing may be implemented under the control of the CPU 63, based on a program stored in the ROM 64.

In the first place, in the step S11, image data to be displayed in a current frame is inputted. In the step S12, the frame rate of the image is doubled. Next, in the step S13, pixel data items for the image to be displayed in the current are compared with corresponding pixel data items, for a two-frame-prior image, that have been stored in the memory 503. In the case where the respective pixel data items for the frames coincide to each other, the process advances to the step S16, but in the case where the respective pixel data items for the frames do not coincide to each other, the process advances to the step S15, and with the driving voltage corresponding to a pixel where the respective pixel data items do not coincide to each other raised, the over-voltage driving: is implemented. Next, in the step S16, the polarity inverter 106 reverses on a frame basis the polarity of the signal and outputs to the D/A converter 35. Next, in the step S17, the liquid-crystal panel is driven to display. In the step S18, it is determined whether or not the display processing has been completed . . . . If the display processing has not been completed, the process returns to the step S11 and the above mentioned processing is implemented for the following frame.

As explained heretofore, according to the second embodiment, because no imbalance in the over-voltage driving occurs between normal-polarity driving and reversed-polarity driving, the reliability of display is raised.

In addition, in the second embodiment, the 120 Hz double-speed conversion is implemented in the resolution converter 501. Therefore, unlike the first embodiment described above, the second embodiment does not require the double speed converter and a memory for the double speed converter, whereby a great effect is demonstrated in terms of reduction of costs and mounting areas.

Additionally, in the second embodiment, the frame rate is doubled before the response speed is corrected (in the step S12). For that reason, in order to correct the response speed, in a case where the image data items are compared, a present-frame image is compared with a two-frame-prior image.

It will be explained below what kind of problem occurs in the case where, as is the case with the first embodiment, image data for a current frame is compared with image data for a one-frame-prior.

Reference Example

FIGS. 13 to 16 are each a chart, representing a signal waveform in a corresponding signal processing block, for explaining a malfunction caused through comparison between image data for a current frame and image data for a one-frame-prior.

Image data inputted to the resolution converter 501 is converted by the resolution converter 501 into image data having a desired resolution and a desired frame rate. In Reference Example, the image data is converted to image data having a frame rate of 120 Hz.

On that occasion, by storing, in the memory 502, inputted image data for at least one frame and changing the speed of reading the image data, the inputted image data can be converted into an output signal having a frame rate different from that of the inputted image signal.

Figure 13:
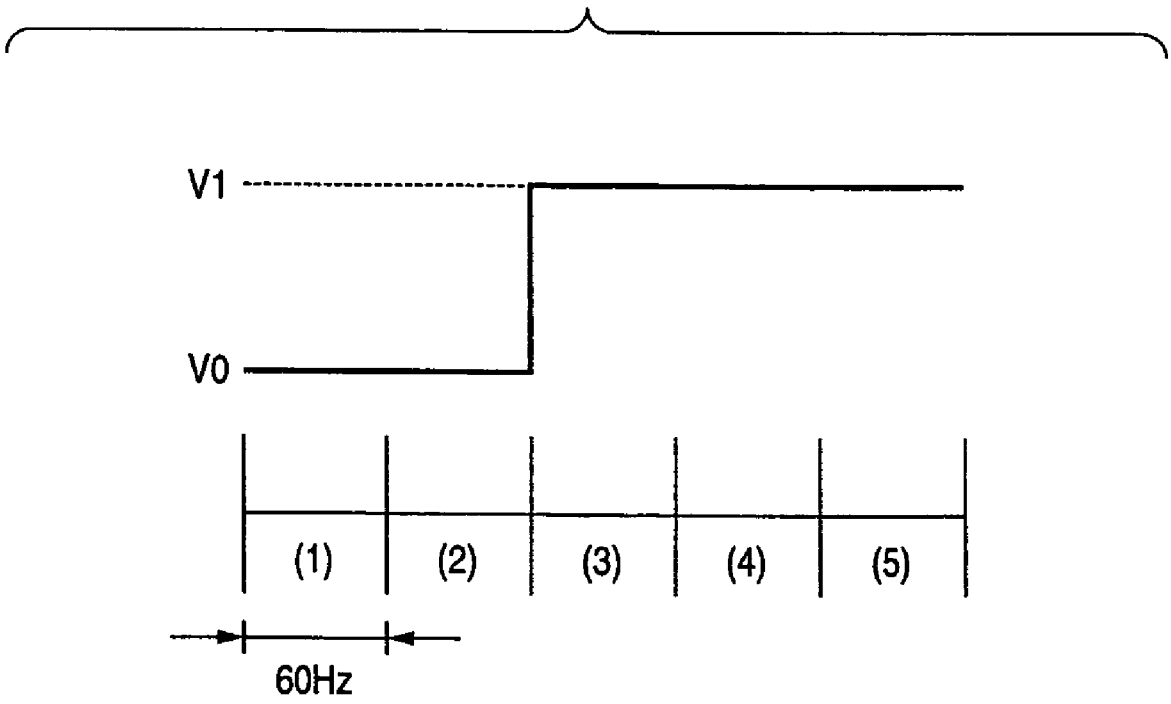
FIG. 13 is a chart representing, as a reference example, a signal that is inputted to the resolution converter and drives a specific pixel of a liquid-crystal panel.

FIG. 13 is a chart representing a signal that is inputted to the resolution converter 501 and drives a specific pixel of a liquid-crystal panel. In Frames (1) and (2), a black-color signal (voltage V0) is applied to the pixel, and the black-color signal is changed in Frame (3) to halftone-gradation pixel data (voltage V1).

Figure 14:
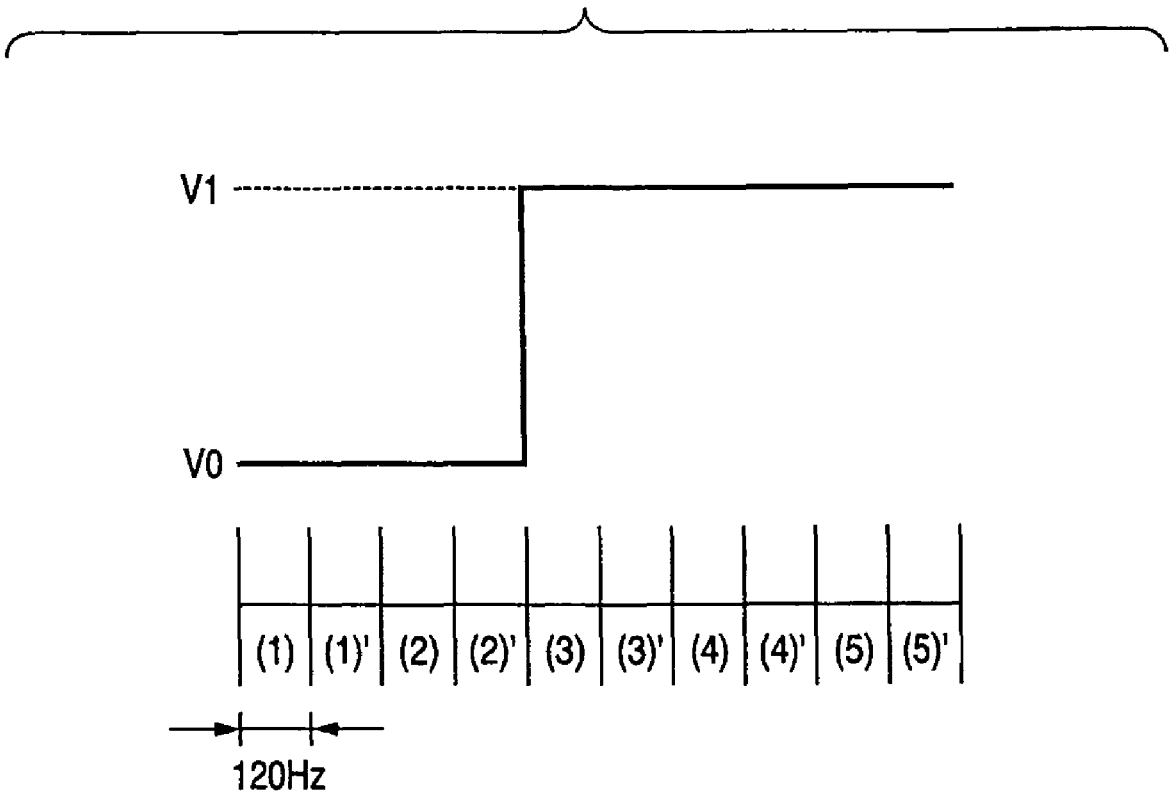
FIG. 14 is a chart representing image data outputted from the resolution converter as a reference example.

FIG. 14 is a chart representing image data outputted from the resolution converter 501.

In the resolution converter 501, the frame rate is converted from 60 Hz to 120 Hz. In the resolution converter 501, by reading, twice in series, image data stored in the memory 502, the frame rate is doubled. Next, in order to improve the response speed of the liquid-crystal display apparatus, the response speed corrector 504 implements so-called over-voltage driving.

Figure 15:
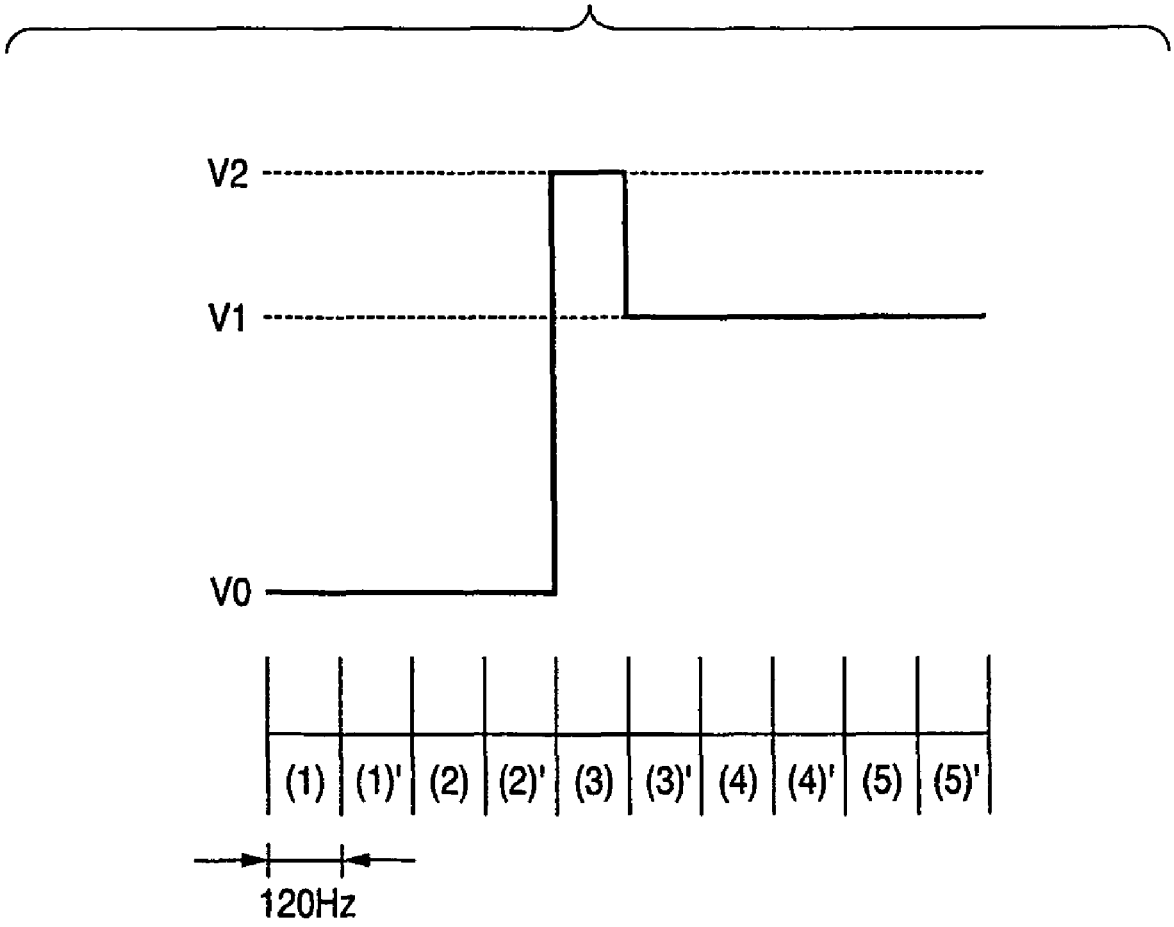
FIG. 15 is a chart representing, as a reference example, image data outputted from the response speed corrector.
Figure 16:
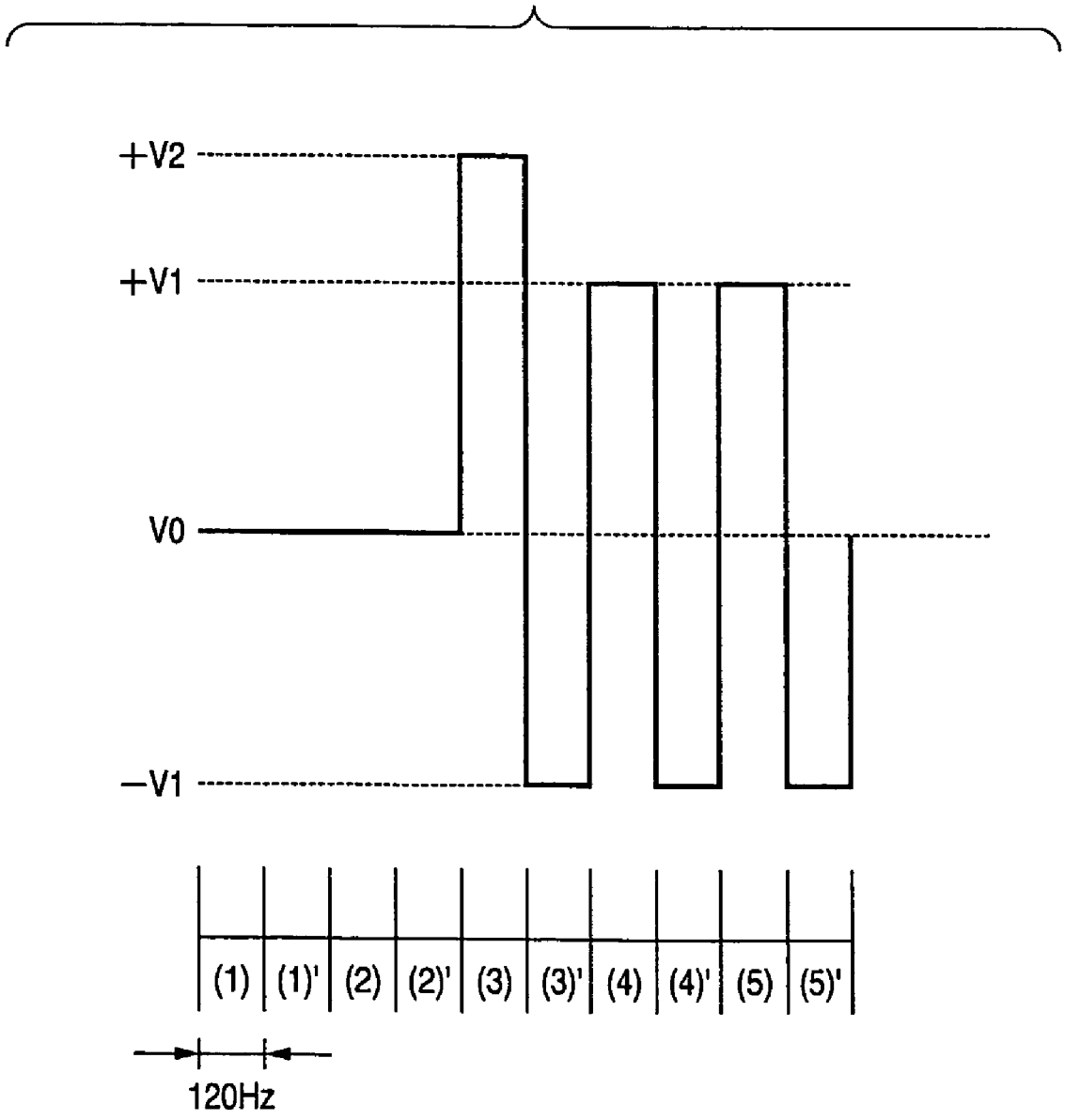
FIG. 16 is a chart representing, as a reference example, a state in which, in a polarity inverter, the polarity of a signal to which the double-speed conversion has been applied is reversed on a frame basis.
Figure 17:
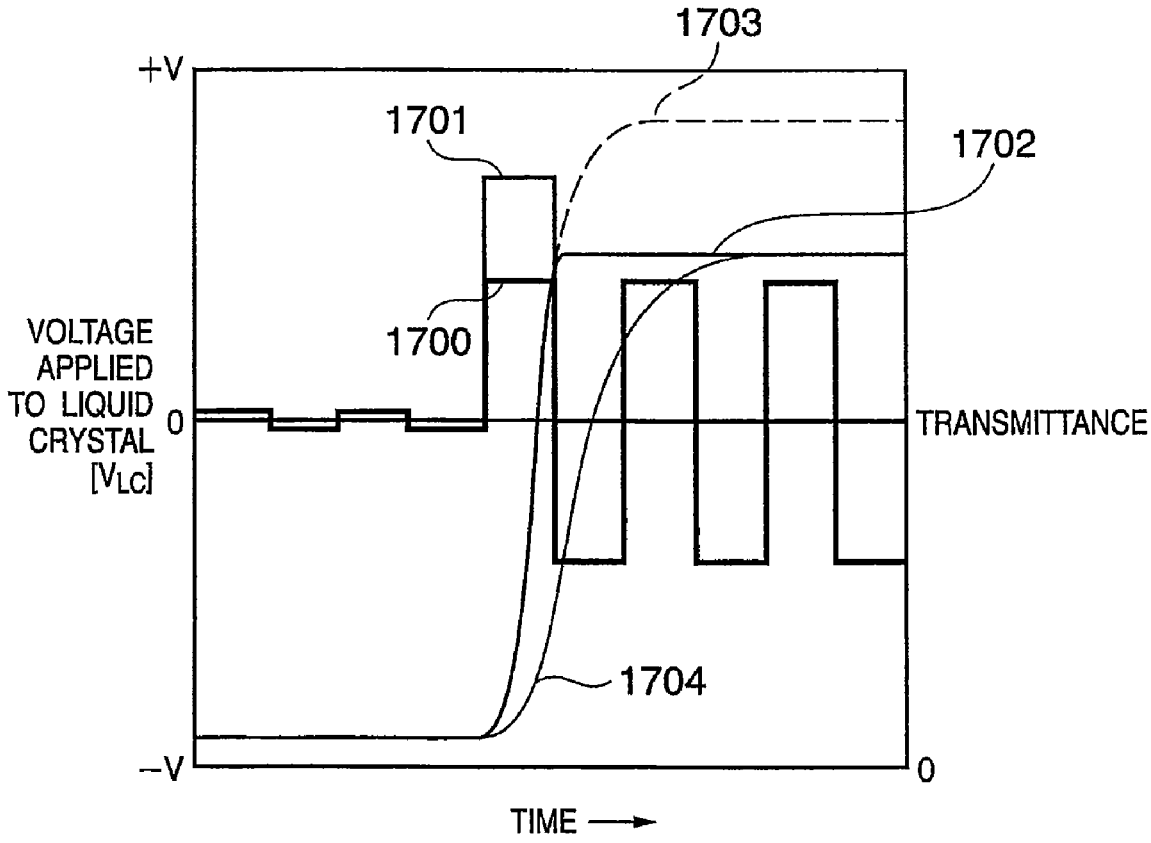
FIG. 17 (PRIOR ART)
FIG. 17 is a chart for explaining a conventional correction method.

FIG. 15 is a chart representing image data outputted from the response speed corrector 504.

In the response speed corrector 504, pixel data, for a one-frame-prior image, that has been stored in the memory 503 is compared with corresponding pixel data to be displayed in a current frame. In this situation, if any pixel-data change exists, the over-voltage driving is implemented in response to the result. As represented in FIG. 15, driving (with a voltage V2) is implemented, with an extra voltage for overdriving added, in Frame (3) in which, compared with one-frame-prior image, change occurs in the input signal, from the black-color level to the halftone-gradation level. In this case, the over-voltage driving is applied only to Frame (3), but the over-voltage driving is not implemented in Frame (3)'.

In the polarity inverter 505, the signal outputted from the response speed corrector 504 reverses its polarity every one frame whose rate has been converted to 120 Hz. Accordingly, as represented in Frames (3) and (3)' in FIG. 16, the over-voltage driving consists of normal-polarity driving (+V2) and reversed-polarity driving (−V1), thereby being not balanced, therefore, a DC component occurs.

As described above, a problem exists in which, when the frame rate is doubled before the response speed is corrected, and the image data for a one-frame-prior image is utilized as an image data to be compared, an imbalance, in the over-voltage driving, between the normal-polarity driving and the over-voltage driving occurs.

Therefore, in the case where, as in the second embodiment, the frame rate is doubled before the response speed is corrected, image data to be compared in correction of the response speed should be the image data for a two-frame-prior image.

In the second embodiment, a case has been explained in which the frame rate is doubled before the response speed is corrected. In the case where the frame rate is multiplied by N, image data to be compared in correction of the response speed may be the image data for an N-frame-prior image.

According to the second embodiment, an effect is demonstrated in which, in contrast to the first embodiment, in FIG. 3, that requires three memories 33, 102, and 105, only two memories 502 and 503 are required, as illustrated in FIG. 8.

As explained heretofore, according to a display apparatus related to any one of the first and the second embodiments, in a liquid-crystal display apparatus in which AC driving is implemented, the same image is recurrently outputted at the beginning of normal-polarity driving or reversed-polarity driving and an equal-amount correction signal is given to the respective driving waveforms in normal-polarity driving and reversed-polarity driving. As a result, deterioration, in a signal, due to a DC component caused by over-voltage driving can be improved. In particular, a configuration according to any one of the present embodiments can be applied to a commonly used display apparatus, without employing a special structure. Moreover, it is possible to provide a high-image-quality display apparatus, without deteriorating reliability.

Still moreover, in the present embodiments, a case has been explained in which the frame rate is doubled. The present invention is not limited to the doubled frame rate, and, for example, any frame rate may be accepted as long as it is an integer (N)-fold frame rate.

Furthermore, according to the second embodiment, by, prior to response-speed correction, implementing N-fold-speed driving and utilizing N-frame-prior data, as comparison data in accordance with which the response speed is corrected, the capacity of a frame memory can be reduced, whereby a low-cost display apparatus can be provided.

The present invention is not limited to the above embodiment, and various changes and modifications can be made thereto within the spirit and scope of the present invention. Therefore, to apprise the public of the scope of the present invention, the following claims are made.

This patent application claims the benefit of Japanese Patent Application No. 2005-107747, filed Apr. 4, 2005, which is hereby incorporated by reference herein in its entirety.

What is claimed is:

1. A display apparatus comprising:

a drive correction unit that compares image data items on a frame basis and changes a driving voltage on the frame basis for image data to be displayed, in accordance with the result of the comparison;

a magnification unit that raises at N times a frame rate of the image data to be displayed by the driving voltage changed by the drive correction unit, wherein N is an even number; and a driving signal generation unit that changes the polarity of the driving voltage for the image data to be displayed at the raised frame rate raised by the magnification unit and generates a display driving signal.

2. The display apparatus according to claim 1, wherein the driving signal generation unit generates the display driving signal whose polarity is changed at the raised frame rate.

3. The display apparatus according to claim 1, wherein the magnification unit has a memory for storing image data for at least one frame and raises at N times a speed of reading the image data from the memory so as to raise the frame rate at N times.

4. A display apparatus comprising:

a frame rate magnification unit that raises at N times a frame rate of image data to be displayed, wherein N is an even number;

a drive correction unit that compares image data items of current N frames with image data items of prior N frames, whose frame rates have been raised by the frame rate magnification unit, and changes a driving voltage for the image data of current N frames in accordance with the result of the comparison; and a driving signal generation unit that changes the polarity of the driving voltage for the image data of current N frames, that is changed by the drive correction unit, and generates a display driving signal based on the driving voltage whose polarity is changed, in accordance with the raised frame rate that has been raised at N times by the frame rate magnification unit.

5. The display apparatus according to claim 4, wherein the driving signal generation unit generates the display driving signal whose polarity reverses at the raised frame rate.

6. The display apparatus according to claim 4, wherein the magnification unit has a memory for storing image data of at least one frame and raises at N times a speed of reading the image data from the memory so as to raise the frame rate at N times.

7. A display control method for a display apparatus, comprising:

a drive correction step of comparing image data items on a frame basis and changing a driving voltage on the frame basis for image data to be displayed in accordance with the result of the comparison;

a magnification step of raising at N times a frame rate of the image data to be displayed, that is displayed by the driving voltage changed in the drive correction step, wherein N is an even number; and a driving signal generation step of changing the polarity of the driving voltage for the image data to be displayed at the raised frame rate raised in the drive correction step and generating a display driving signal.

8. The display control method according to claim 7, wherein, in the driving signal generation step, the display driving signal whose polarity reverses at the raised frame rate is generated.

9. The display control method according to claim 7, wherein, in the magnification step, a speed of reading the image data from a memory that stores image data for at least one frame is raised at N times.

10. A display control method for a display apparatus, comprising:

a frame rate magnification step of raising at N times a display frame rate of image data to be displayed, wherein N is an even number;

a drive correction step of comparing image data items of current N frames with image data item of prior N frames, whose frame rates have been raised in the frame rate magnification step, and changing a driving voltage for the image data of current N frames in accordance with the result of the comparison; and a driving signal generation step of changing the polarity of the driving voltage for the image data of current N frames, that is changed in the drive correction step, and generating a display driving signal based on the driving voltage whose polarity is changed, in accordance with the raised frame rate that has been raised at N times in the frame rate magnification step.

11. The display control method according to claim 10, wherein, in the driving signal generation step, the display driving signal whose polarity reverses at the raised frame rate is generated.

12. The display control method according to claim 10, wherein, in the magnification step, a speed of reading the image data from a memory that stores image data for at least one frame is raised at N times.

* * * * *